United States Patent [19]

Bagwell et al.

[11] Patent Number: 4,500,071

[45] Date of Patent: Feb. 19, 1985

[54] DUAL HYDRAULIC LIFTS

[76] Inventors: Bobby F. Bagwell, 52 W. Main St.; Rickey D. Wells, 50 W. Main St., both of Broadalbin, N.Y. 12025

[21] Appl. No.: 414,886

[22] Filed: Sep. 3, 1982

[51] Int. Cl.[3] ..... B66F 7/12

[52] U.S. Cl. ..... 254/423

[58] Field of Search ..... 187/8.41, 8.47, 8.59; 254/89 H, 2 B, 93 R; 91/170, 520; 60/546

[56] References Cited

U.S. PATENT DOCUMENTS

| | | | |
|---|---|---|---|
| 2,909,358 | 10/1959 | Southerwick | 254/2 B |
| 2,940,262 | 6/1960 | Pfitzenmeier | 91/520 |
| 3,143,924 | 8/1964 | Pearson et al. | 91/171 |
| 3,355,993 | 12/1967 | Williamson | 91/171 |
| 3,476,016 | 11/1969 | Dixon et al. | 91/520 |
| 4,212,449 | 7/1980 | Tsujimura | 254/89 H |

*Primary Examiner*—Robert C. Watson
*Attorney, Agent, or Firm*—Murray Schaffer

[57] ABSTRACT

A dual lift for large loads such as vehicles has two lifting units set in opposition to each other to straddle the load. Each of the lifting unit has a vertical standard, cantilevered arms mounted on the standard for movement therealong, and a hydraulic actuator for raising and lowering said arm. A source of fluid under pressure such as a motor, pump, and reservoir provides fluid under pressure, transferred first to one of the actuators, and from this first actuator between it and the other in a reversible series. The first actuator functions as a master and the other actuator as a slave thereto so that actuation of the slave is synchronized directly with the operation of said master.

8 Claims, 5 Drawing Figures

HYDRAULIC CIRCUIT DIAGRAM

DUAL HYDRAULIC LIFTS

BACKGROUND OF THE INVENTION

The present invention relates to apparatus for lifting large and heavy loads such as vehicles and, particularly, to hydraulicly operated synchronized dual lift systems.

It is frequently necessary to lift vehicles so as to enable work to be done on their under carriage or the chasis thereof. This is a particularly onerous task when large vehicles such as trucks or the like are to be lifted, since a single lift is not strong enough nor can it be sufficiently stable to lift the same from one side or the other.

It has been known to provide hydraulic lifts having a center cylinder and a pair of outrigger tread platforms. Such devices require a central well which is costly to construct and have the further disadvantage that the vehicle rests with its wheels on the platform, so that access to the wheels and the appertuant portions of the vehicles is impossible.

It has also been known to employ a pair of opposed hydraulic lifts with cantilevered arms extending beneath the vehicle. While this arrangement provides the worker with freedom to get at the wheels and other parts of the vehicle, a particular problem exists in operating dual lift apparatus in synchronism so that a balanced lifting of the vehicle is obtained.

It is the object of the present invention to provide a dual lift system which overcomes the disadvantages of the prior art.

It is a further object of the present invention to provide a dual lift system in which the lifts are structually similar and in which the hydraulic power systems are synchronously operated with a minimum of interconnecting flow conduits or piping between the units.

These objects, as well as other objects and advantages, will be apparant from the following disclosure.

SUMMARY OF THE INVENTION

According to the present invention apparatus for lifting large loads such as vehicles and the like is provided comprising dual lifting units set in opposition to each other to straddle the load. Each of the lifting unit comprises a vertical standard, cantilevered arms mounted on the standard for movement therealong, and a hydraulic actuator for raising and lowering said arm. A source of fluid under pressure such as a motor, pump, and reservoir are provided. The fluid under pressure is transferred first to one of said actuators, and from this first actuator between it and the other in a reversible series. The first actuator functions as a master and the other actuator as a slave thereto so that actuation of the slave is synchronized directly with the operation of said master.

The synchronization between the master and the slave units is effected by the reversible serial flow of the hydraulic fluid in a circuit between source, first actuator, second actuator and return. Since the master actuator is in one lift unit, and the slave in the other, and both are directly connected to the lifting arms a uniform, equal and level, lifting of the arms is obtained, with equal force on both the lift arms.

Full details of the present invention are illustrated in the accompanying drawings and are set forth in the following description.

DESCRIPTION OF THE INVENTION

Figure 1:
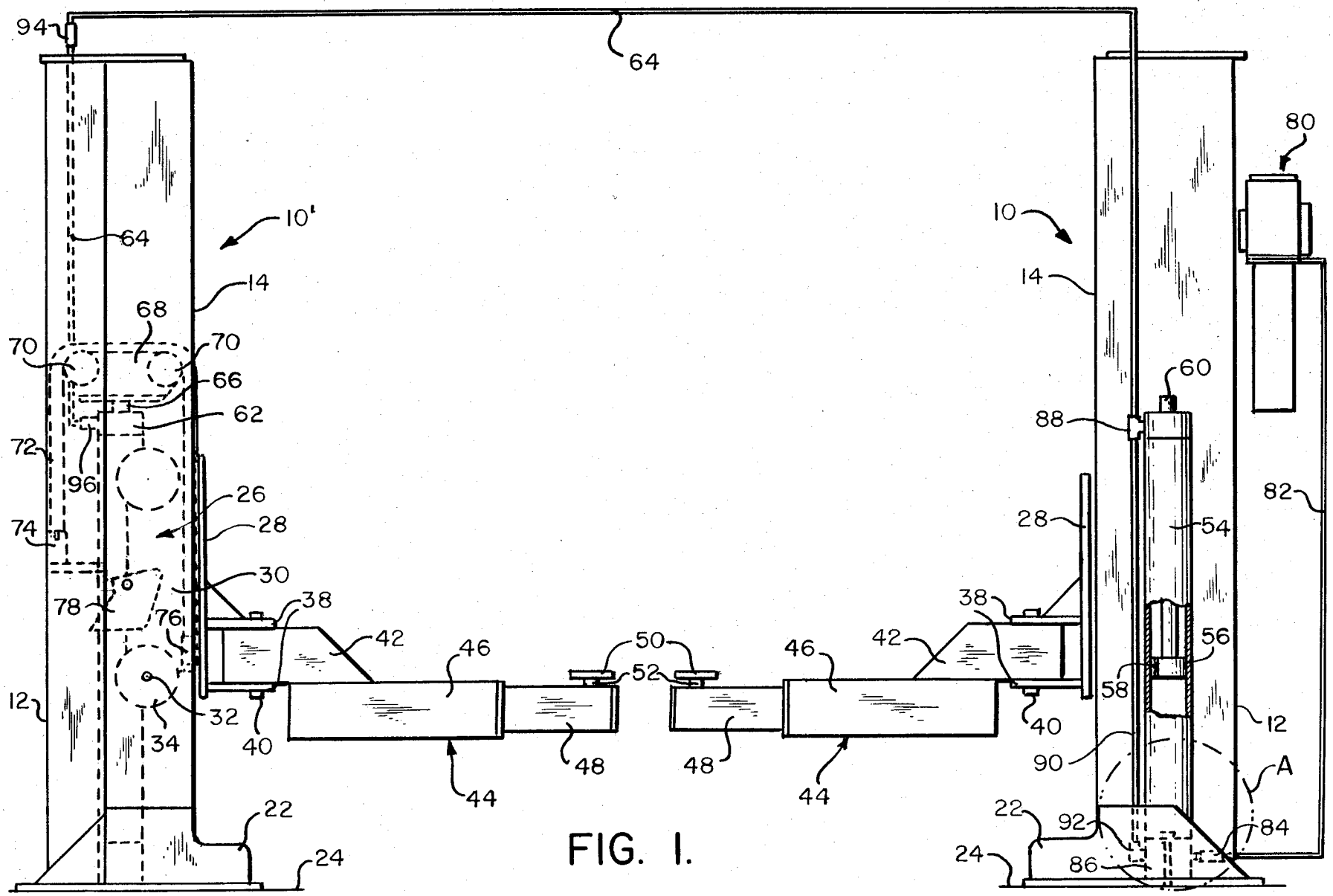
FIG. 1 is a front elevational view partly in section of the dual lift apparatus of the present invention.

As seen in FIG. 1, the system comprises a pair of lifts (one being master, the other slave), generally depicted by the respective numerals 10 and 10'. Each lift comprises an elongated vertical standard 12 formed of a pair of U-shaped vertical rails 14 placed in aligned opposition to each other, a third or rear rail 16, set between and slightly behind the U-shaped rails and a covering shroud 18. The rails are fixedly mounted on a low profile base 22, which may be secured to the floor or other ground support 24.

Movably mounted in each standard is a carriage 26 comprising a face plate 28 of sufficient width to bridge the two U-shaped rails 14. The face plate 28 has on its rear, a pair of spaced ribs 30 in which a pair of traverse axles or shafts 32 are located and on each of which a pair of wheels 34 are journalled. The wheels fit within the U-shaped rails, thus, coacting with the face plate to hold the carriage within the rails, but permitting free vertical movement in the rails.

To the front face 28 of the carriage is welded or otherwise integrally formed a pair of spaced horizontal plates 38 between which is pivotally mounted, by use of suitable bolts 40, a pair of supporting brackets 42 to each of which is secured or integrally attached a telescoping lift arm 44. The brackets 42 and telescoping lift arms 44 on each carriage is, thus, swingable in a horizontal plane toward and away from each other so that they can be spread apart at their forward ends. The telescoping lift arms 44 are preferably manually operable, although hydraulic telescoping arms may be used. The telescoping arms which is preferably rectangular in cross section comprises a rear outer sleeve 46 and an inner movable bar 48 on the front end of which is mounted a support pad 50. The support pad is provided with a central screw 52 fitting into a threaded hole so that its height above the level of the bar can be easily adjusted. It will, thus, be seen that by swiveling the telescoping arms about the supporting bolts 40, elongating or shorting the extension of the bar 48 relative to the sleeve 46, and raising or lowering the pads 50, an infinite range of lengths, width and heights of undercarriages or other objects can be accomodated.

As will be obvious from the drawing, the structure of the master and slave lift is basically the same, and similar parts bear identical reference numerals. The carriages in each instance, are actuated by hydraulic actuators or motive means which provide for the synchronization of the slave to master. However, they are slightly different.

The master lift 10 is provided with an actuator located behind the carriage and fixed for support to the base 22. The actuator comprises a cylinder 54 having a piston 56 dividing it into an upper and lower chamber. The piston 56 is provided with a spring loaded ball check 58 permitting equalization of the hydraulic fluid into the respective chambers to effect movement of the piston in the desired mode. The ball check 58 is normally open when the piston is in its lower most position, permitting fluid first to move from the lower to upper chambers. Once fluid is equalized in pressure, the ball check value closes. Extending upwardly from the piston through the cylinder, is the piston rod 60.

In the slave lift 10', a single chamber piston cylinder 62 is provided. The chamber of this piston cylindr is connected by conduit 64 to the upper chamber of the cylinder 54 in the master slave unit, so that the actuation of the slave cylinder depends upon flow of fluid to and from the upper cylinder of the master cylinder 54. The piston is provided with an extending piston rod 66.

Although it need not necessarily be so, the attachment of the piston 60 and 66 of the respective master and slave cylinders to carriages is preferably the same and is clearly shown in the slave lift. The respective piston 60 and 66 is secured to a yoke 68 on which is mounted in the same horizontal plane a pair of freely rotatable wheels 70 over which a chain 72 runs.

One end of the chain 72 is fixed to the rear post of the standard by a suitable bracket 74 while the other end of the chain is fixed by a similar bracket 76 to the rear wall of the carriage plate 28. Thus, on extending or retracting the piston, the run or piston of the chain between the yoke and the carriage is lengthened or shortened, thus, lowering or raising the carriage.

It will be appreciated that the cylinders are located and dimensioned so that their piston strokes or displacements are equal, and that from a structural point of view, the telescoping arms begin and end at the same horizontal levels.

Each lift is provided with a safety latch 78 which is pivotally mounted to the standard so as to be movable between the wheels of the carriage, thus preventing the carriage from being lowered. The latch is manually movable out of engagement prior to the lowering operation of the lift.

Figure 2:
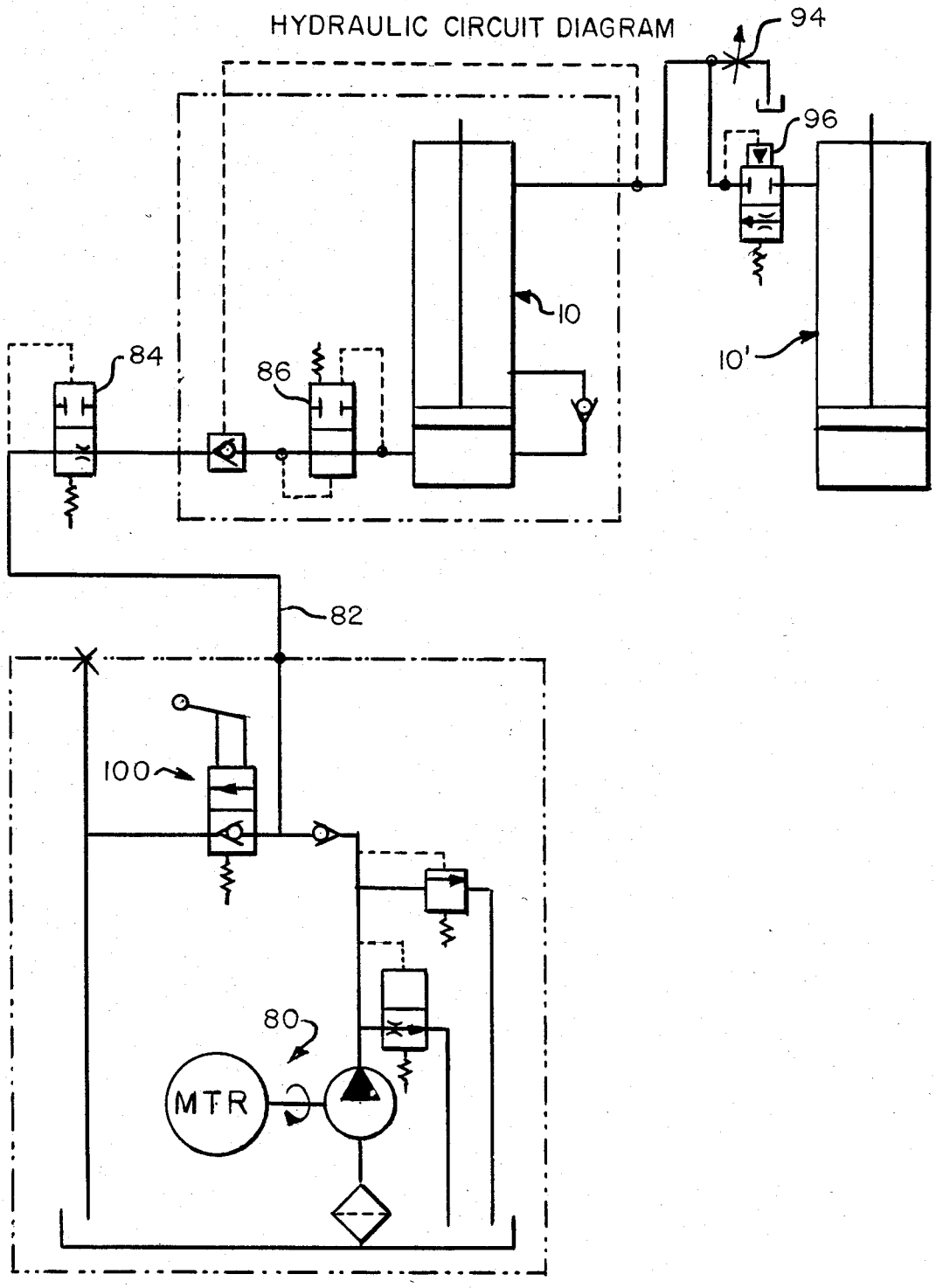
FIG. 2 is a diagram of the hydraulic circuit employed in the apparatus of FIG. 1.

As seen in FIG. 2, the arrangement is provided with hydraulic fluid from a reservoir under pressure via a power unit comprising a motor and pump 80 which may be mounted for convenience on the rear of the standard of the master lift 60. The hydraulic fluid is then fed via line 82 to a velocity valve 84 and an inlet spool 86 to the lower chambers of the master cylinder 54. Extending from the conduit 64 to the inlet spool 86 via a Tee fitting 88 is a bypass line 90 and pilot valve 92.

The conduit 64 between the master and slave includes a bleeder valve 94, as well as a velocity valve 96.

As seen in FIG. 2, a manual control 100 and suitable conventional regulating valves and pressure controls 102 for operating the motor and pump 80, a properly controlled flow of hydraulic fluid from the reservoir to the lifts at a preset maximum pressure, and a return to the reservoir from the lifts.

Figure 4:
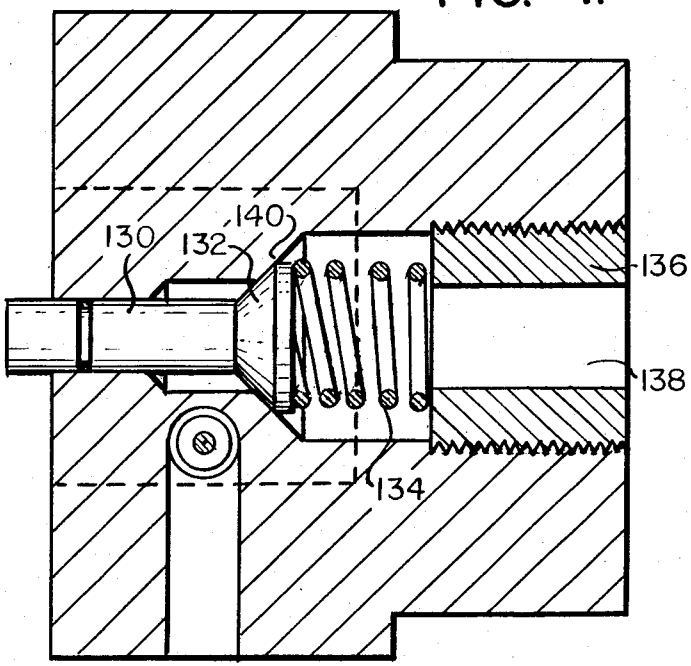
FIG. 4 is a sectional view along lines IV—IV of FIG. 3.
Figure 3:
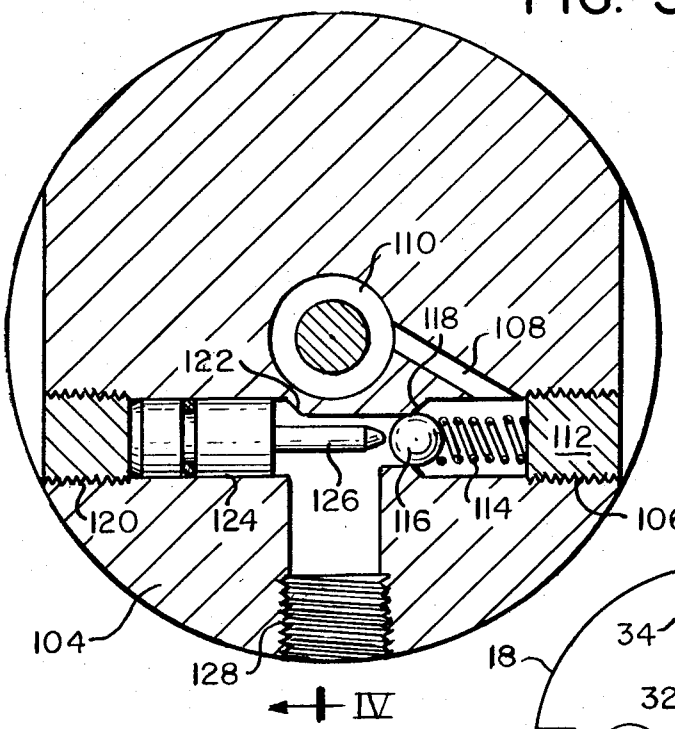
FIG. 3 is a sectional view in plan of the manifold valve assembly of the portion A circled in FIG. 1.
Figure 5:
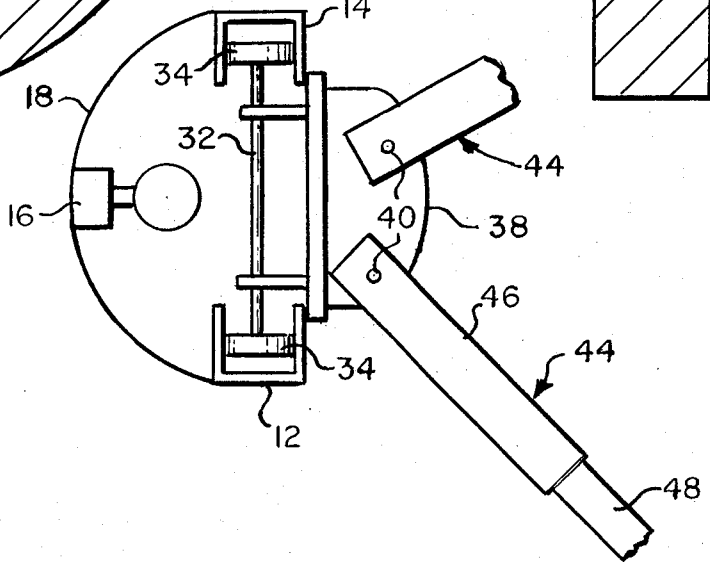
FIG. 5 is a plan view of the standard, and the telescoping arms shown in FIG. 1.

The pilot pressure sensing valve 92 and inlet spool valve 86 are depicted in FIGS. 3 and 4. These valves are housed in a manifold 104 having a horizontal through bore 106 in which the pilot valve is situated and which communicates via a passage 108 to an axial bore 110 in which the inlet spool valve 86 is situated. One end of the through bore is closed by a threaded plug 112 against which one end of a spring 114 is situated, the other end of the spring bears against a ball 116. The through bore 104 is narrowed to provide a seat 118 for the ball, which under the bias of the spring 114, is normally closed thereon. The opposite end of the through bore 104 is threaded to receive the bypass line 90 from the slave actuator. Freely movable in the bore 104, between the threaded end 120 and a shoulder 122 is a piston 124 having an extending finger 126 pointed directly at the ball 116. In the extreme position abutting the threaded end 120, the piston 124 is located so that the finger is free of the ball 116, but in the other extreme position, the finger lifts the ball from its seat 118.

The manifold is provided with a threaded inlet 128 from the velocity valve 84 for introduction of fluid under pressure. At the preset pressure, the fluid pressure is intended to be sufficient to move the piston 124 to its extreme position against the threaded end 120 while, simultaneously lifting the ball 116 from its seat 118 to permit normal flow of the fluid into the passage 118 so that it flows into the inlet spool bore 110.

The inlet spool 96, as seen in FIG. 4, comprises a shaft 130 having a conically shaped piston head 132 which abuts against a spring 134 held in place by a ring 136, threaded into the bore 110 at the top of the manifold 104, providing, as well, a passage 138 into the bottom chamber of the master cylinder. The interior of the bore 110 is provided with a conical neck 140 conforming to the taper of piston head 132, so as to form a seat therefor. The bias of the spring 134 is such that it normally seats the piston head 132, but is overcome on flow of fluid from passage 108, at the predetermined operating pressure.

As seen from the foregoing, the pilot piston valve and the ball are urged apart (unseating the ball) on greater differential pressure from the inlet than from the master or slave actuators, but the spool valve is closed on a greater differential pressure from the master actuator relative to both the inlet and the slave pressure.

The arrangement operates as follows:

To raise the telescoping arms the control valve 100 is operated, causing the power source (motor and pump 80) to provide a controlled flow of hydraulic fluid at the predetermined maximum pressure. The fluid then passes through the normally open master cylinder velocity valve 84 at a free flowing rate and from there into the manifold of the pilot and inlet spool valve which is normally closed. As seen from FIG. 3, the pressurized fluid causes the ball 116 to lift from its seat allowing fluid to pass through into the spool valve and thence into the lower chamber of the master cylinder 54. After entering the lower chamber of the master cylinder, the fluid passes through the normally open piston check valve 58 into the upper chamber of the master cylinder. The fluid then exists through the Tee 88 and passes via conduit 64 to the slave cylinder 62 via its velocity valve 96. Simultaneously, the fluit exiting from the upper chamber of the master cylinder passes into the pilot valve 92, serving as a pressure sensing source for its operation.

Once all of the chambers of both the master and slave cylinders are filled with fluid, an equilibrium is established, and the piston check valve 58 closes. Continued application of the pressurized fluid into the lower chamber of the master cylinder causes the piston 56 to rise, thus effecting the lifting of its associated carriage, while simultaneously increasing the pressure in the upper chamber, which is transmitted to the slave cylinder causing a corresponding rise in the pressure of the slave cylinder and its associated carriage.

To lower the carriages and the telescoping arms, the control valve 100 is shifted to allow a return of fluid from the cylinders into the fluid reservoir.

The fluid flows out of the slave cylinder returning to the upper chamber of the master cylinder, simultaneously providing a branch via the bypass line 90 to the pilot valve 92. This latter flow produces a pressure on the pilot piston 124 forcing the finger 126 to maintain the ball 116 lifted from its seat 118. This insures the return of the fluid from the master cylinder to the reservoir.

The force of the returning pressurized fluid at the upper chamber of the master cylinder and the load of the carriage and the object carried by it forces the fluid out of the master cylinder through the inlet spool valve, the master velocity valve, etc. into the reservoir.

It will be seen from the foregoing that the present system provides a synchronous raising and lowering of the master and slave lifts with several fail safe characteristics while providing a clear floor between the independent lift standards or columns.

The sole interconnection between the master and slave units, other than the load or object being carried is the single conduit line 64, which may be installed overhead over the top of both standards at a height sufficient to clear the tallest load when lifted to maximum elevation.

The synchronization features of the present system is accomplished by use of a "MASTER-SLAVE" cylinder concept. While the master cylinder is located in one column and the slave cylinder is located in the other column, the master cylinders' rod end has a displacement equal to the slave cylinders' piston end. Since the slave cylinder is supplied power from the rod side of the master cylinder and the displacement are equal and hydraulic fluid is virtually incompressible, the synchronization requirement is easily attained. The master cylinder is the primary controlling element in this system; therefore; it is where the majority of the failsafe features have been placed. Designed as an integral part of the master cylinder are multi-function failsafe valves:

1. The pilot valve 92 which acts as slave to master pilot pressure sensor valve and control;
2. Inlet spool 84 which acts as master sensor valve;
3. Piston check valve which acts to equalize flow;
4. The velocity valves which control flow to both master and slave cylinders.

The pilot valve closes off all flow of hydraulic fluid if for any reason a pressure unbalance exists or occurs, stopping all movement. This will safely stop the movement of the lift if the slave side chain breaks, if the mechanical safety latch is left engaged on the slave side and the master side latch has been released and the load is being lowered, if the slave side carriage stops and the loaded is being lowered or raised.

The inlet spool valve will close off all flow of hydraulic fluid, if for any reason the load on the lifting chain of the master cylinder yoke is removed, stopping all movement. This will safely stop all movement if, the master side chain breaks, if the mechanical safety latch is left engaged on the master side and the slave side latch has been released and the load is being lowered or raised, if the master side carriage stops and the load is being lowered or raised.

The piston valve provides an automatic means of equalizing the volume of hydraulic fluid between the master and slave cylinders. Further, since the pressure setting of this valve is set in conjunction with the pressure setting of the power unit, this valve will perform its task properly up to the limit of which the power source can provide. In simpler terms the only way it will malfunction is if the lift was raised unloaded, or an excessive load was placed onto the lift (which the power source could NOT raise itself).

The manner in which the flow is equalized is as follows: With the master cylinder fully extended, this valve opens allowing a flow of fluid to initially extend and purge the slave cylinder. With the master cylinder fully retracted, this valve is held open allowing any excess fluid from the slave cylinder to transfer thereby balancing the fluid level in this mode of the operation.

The bleeder valve 94 is provided at the proper elevation in the circuit to allow a means of evacuating all air from the system. This is done when performing the purging of the slave system during flow equalization procedure.

The velocity valves located at both the master and slave cylinder inlet ports will stop all flow of fluid trying to escape from either cylinder should either hydraulic line be knocked off or broken.

Various modifications, changes and alternate embodiments have been disclosed and others will be clearly obvious to those skilled in the art. Accordingly, the present disclosure is intended as illustrative only of the present invention and not restrictive thereof.

What is claimed:

1. Apparatus for lifting large loads such as vehicles and the like comprising a pair of lifting units set in opposition to each other to straddle said load, each lifting unit comprising a vertical standard, a cantilevered arm mounted on said standard for movement therealong, and a hydraulic actuator for raising and lowering said arm, one actuator functioning as a master comprises a cylinder, a piston located in said cylinder and dividing the same into lower and upper chambers, and a piston rod extending from said piston outwardly of the upper chamber and connected to said cantilevered arm, the other actuator functioning as the slave comprises a cylinder having a single chamber, a piston located therein, and a piston rod extending from said piston outward of said chamber and connected to its associated cantilevered arm, a source of fluid under pressure and means for serially transfering fluid from said source to said master actuator and thence to said slave actuator said means comprising a first conduit connecting said source of fluid to said lower chamber of said master actuator, and a second conduit connecting said upper chamber of said master actuator to said single chamber of said slave actuator and valve means operable to effect passage of fluid between said lower and upper chambers of said master cylinder, establishing equal pressure in the chambers of said master and slave actuators and to effect thereafter simultaneous and uniform movement of the pistons in said master and slave actuator.

2. The apparatus according to claim 1 wherein the means for transferring said fluid under pressure includes valve means in said first conduit between the source of fluid under pressure to regulate the transfer of fluid between said source and said master actuator, said valve means including a spool valve responsive to the supply of fluid under pressure from said supply to permit transfer of fluid to said master actuator, and in response to a greater pressure within said master actuator to prevent passage therethrough.

3. The apparatus according to claim 2 wherein said valve means includes a pilot valve responsive to pressure, from said slave valve, greater than said fluid supplied from said source under pressure to maintain said spool valve open for the return of fluid to said source.

4. The apparatus according to claim 3 wherein said spool and pilot valve are contained in a manifold block, said block comprising a horizontal bore closed at one end, and a central axial bore separate therefrom, said pilot valve comprising an inlet from said slave actuator to the open end of said horizontal bore, a piston located in said through bore and movable in response to flow of pressurized fluid from said slave actuator, a ball valve seated in said through bore and being biased by a spring abutting the closed end to normally seat an inlet into said through bore from said source of fluid under pressure to urge said piston and ball apart on a greater differential in pressure from said source then from said slave actuator, and to cause said piston to unseat said ball on a greater differential in pressure from said slave actuator then from said source, a conduit between said horizontal bore, and said vertical bore, having an end terminating between said ball and the plugged end of said horizontal bore, said spool valve comprising a piston movable in said axial bore and having a concially tapering head seating on a conforming portion of said axial bore, the other end of said conduit being located beneath said conical head, said axial bore opening into the lower chamber of said master actuator, said spool valve being open on flow of fluid from said source of a pressure differential greater than that in said master actuator and closed upon flow of fluid in a greater pressure from said master cylinder.

5. Apparatus for lifting large loads such as vehicles and the like comprising a pair of lifting units sets in opposition to each other to straddle said load, each lifting unit comprising a U-shaped vertical standard, a carriage mounted on said standard for movement therealong, a cantilevered arm extending from said carriage, and a hydraulic actuator for raising and lowering said carriage, one actuator functioning as a master comprises a cylinder, a piston located in said cylinder and dividing the same into lower and upper chambers, and a piston rod extending from said piston outwardly of the upper chamber and connected to said cantilevered arm, the other actuator functioning as the slave comprises a cylinder having a single chamber, a piston located therein, and a piston rod extending from said piston outward of said chamber and connected to its associated carriage, said carriage comprises a flat plate having at least two pair of wheels rotatably mounted on its rear surface, wheel means rotatable about a horizontal axis adapted to fit within said rails and and bearing against the walls thereof, the rear surface of said plate slidably abut against the front edge of said rails and cooperating with said wheel means for holding said carriage in position on said standard and a chain running over said wheel means having one end fixed to said standard and the other end fixed to said carriage, a source of fluid under pressure, and means for serially transferring fluid from said source to said master actuator and thence to said slave actuator, said means comprising a first conduit connecting said source of fluid to said lower chamber of said master actuator, and a second conduit connecting said upper chamber of said master actuator to said single chamber of said slave actuator and valve means operable to effect passage of fluid between said lower and upper chambers of said master cylinder establishing equal pressure in the chambers of said master and slave actuators and to effect thereafter simultaneous and uniform movement of the pistons in said master and slave actuator.

6. The apparatus according to claim 5, wherein said plate is provided with a pair of horizontal supporting brackets, and said cantilevered arm comprises a holding bracket pivotally mounted in said supporting bracket for swinging movements in a horizontal plane, a sleeve integral with said holding bracket and a bar member telescopingly secured within said sleeve and adjustable in length parallel to said horizontal plant.

7. The apparatus according to claim 6 including a pad adjustably secured to the forward end of said bar for moving in a vertical direction therewith.

8. The apparatus according to claim 6 wherein a pair of holding brackets, sleeves and bar members are mounted in said horizontal supporting brackets.

* * * * *